US010879621B2

(12) United States Patent
Noh

(10) Patent No.: US 10,879,621 B2
(45) Date of Patent: Dec. 29, 2020

(54) ANTENNA FOR SATELLITE COMMUNICATION CAPABLE OF RECEIVING MULTI-BAND SIGNAL

(71) Applicant: Intellian Technologies INC., Pyeongtaek-si (KR)

(72) Inventor: Jung Pil Noh, Osan-si (KR)

(73) Assignee: INTELLIAN TECHNOLOGIES INC., Pyeongtaek-si (KR)

( * ) Notice: Subject to any disclaimer, the term of this patent is extended or adjusted under 35 U.S.C. 154(b) by 249 days.

(21) Appl. No.: 16/090,710

(22) PCT Filed: Apr. 6, 2017

(86) PCT No.: PCT/KR2017/003763

§ 371 (c)(1),
(2) Date: Oct. 2, 2018

(87) PCT Pub. No.: WO2017/179854

PCT Pub. Date: Oct. 19, 2017

(65) Prior Publication Data

US 2020/0052411 A1 Feb. 13, 2020

(30) Foreign Application Priority Data

Apr. 12, 2016 (KR) ..... 10-2016-0044961

(51) Int. Cl.
*H01Q 3/12* (2006.01)
*H01Q 19/13* (2006.01)
(Continued)

(52) U.S. Cl.
CPC ..... *H01Q 19/132* (2013.01); *H01Q 13/0233* (2013.01); *H01Q 19/08* (2013.01); *H01Q 19/191* (2013.01); *H01Q 19/192* (2013.01)

(58) Field of Classification Search
CPC ..... H01Q 19/132; H01Q 19/13; H01Q 13/02; H01Q 13/0233; H01Q 19/08; H01Q 19/14;
(Continued)

(56) References Cited

U.S. PATENT DOCUMENTS 3,394,378 A 7/1968 Williams et al.
3,914,768 A * 10/1975 Ohm ..... H01Q 19/192 343/779
(Continued)

FOREIGN PATENT DOCUMENTS

KR 20-1997-0006932 Y1 7/1997
KR 10-1998-0087738 A 12/1998
(Continued)

*Primary Examiner* — Tho G Phan
(74) *Attorney, Agent, or Firm* — Novick, Kim & Lee, PLLC; Jae Youn Kim

(57) ABSTRACT

Provided is an antenna for satellite communication capable of receiving multi-band signals. The antenna includes: a main reflector; a first feed horn which is provided on the main reflector and receives a signal of a first band; a first reflector which is disposed to be spaced apart from a reflective surface of the main reflector at a predetermined interval and transmits the signal of the first band to the first feed horn; a second feed horn which is provided on the main reflector and receives a signal of a second band; and a second reflector which is disposed to be spaced apart from the reflective surface of the main reflector at a predetermined interval and transmits the signal of the second band to the second feed horn.

12 Claims, 9 Drawing Sheets

(51) Int. Cl.
*H01Q 13/02* (2006.01)
*H01Q 19/08* (2006.01)
*H01Q 19/19* (2006.01)

(58) Field of Classification Search
CPC .... H01Q 19/19; H01Q 19/191; H01Q 19/192; H01Q 1/12; H01Q 3/12; H01Q 3/18; H01Q 3/20; H01Q 5/45; H01Q 19/18; H01Q 1/125; H01Q 5/25
See application file for complete search history.

(56) References Cited

U.S. PATENT DOCUMENTS 4,092,648 A * 5/1978 Fletcher ..... H01Q 13/0266 343/781 CA
4,792,813 A * 12/1988 Rosen ..... H01Q 25/001 343/756
5,546,097 A * 8/1996 Ramanujam ..... H01Q 25/007 343/781 CA
6,239,763 B1 5/2001 Cuchanski
6,545,645 B1 * 4/2003 Wu ..... H01Q 19/104 343/781 CA
2008/0120653 A1 * 5/2008 Stroes ..... H04H 40/90 725/70
2011/0068988 A1 * 3/2011 Monte ..... H01Q 5/45 343/761
2017/0005415 A1 * 1/2017 Adada ..... H01Q 5/45
2017/0264020 A1 * 9/2017 Jackson ..... H01Q 19/191

FOREIGN PATENT DOCUMENTS

KR 10-2005-0060062 A 6/2005
KR 10-2010-0065024 A 6/2010
KR 10-1045809 B1 7/2011
KR 10-1477199 B1 12/2014
WO 2015002338 A1 1/2015

* cited by examiner

ANTENNA FOR SATELLITE COMMUNICATION CAPABLE OF RECEIVING MULTI-BAND SIGNAL

TECHNICAL FIELD

The present invention relates to an antenna for satellite communication, and particularly, to an antenna for satellite communication capable of receiving multi-band signals which may receive signals through multiple satellite communications.

BACKGROUND ART

In general, an antenna for satellite communication communicates with a satellite by using signals with frequencies of particular bands (e.g., a signal of a first band, a signal of a second band, etc.).

The signal of the first band (e.g., C band) is a signal of a band with a low frequency of about 4 to 8 GHz. The signal of the second band (e.g., Ku band) is a signal of a band with a high frequency of about 10.95 to 14.8 GHz.

In the related art, multiple transmitting/receiving devices or antennas are separately installed corresponding to the bands of the signals in order to transmit/receive and process the signals of the multiple bands.

For example, a satellite phone may be provided through the C band, and a satellite broadcast may be provided through the Ku band and a Ka band, but up to now, devices for transmitting/receiving and processing the signals of the bands are separately installed.

Therefore, costs required to transmit/receive the signals of the multiple bands are greatly increased, and a space in which the devices for transmitting/receiving the signals of the multiple bands are installed is increased. In particular, a process of replacing a feed horn to perform communication through a signal of a particular band causes various inconveniences to an operator. That is, because the operator manually replaces the feed horn in accordance with a manual, a focal point of the feed horn and a focal point of a main reflector may not be accurately adjusted, and a reassembly process is complicated, which causes inconveniences.

In addition, a solution for designing an integrated feed horn capable of performing communication through signals of multiple bands with multiple frequencies may be considered. However, if a first band feed horn and a second band feed horn, which are installed on a satellite antenna, are integrally designed, there is a problem in that weights of the feed horns are increased and structures of the feed horns are complicated.

Furthermore, recently, there is an increasing need for a multi-band signal transmitting/receiving device or an antenna for satellite communication provided with the multi-band signal transmitting/receiving device capable of transmitting/receiving signals of several bands and appropriately processing the transmitted/received signals. In particular, in the case of a movable body such as a ship, an aircraft, or a vehicle, it is very difficult to ensure a space in which multiple converters are installed, and the movable body may receive signals of multiple bands from various locations, and as a result, there is an acute need for a technology of simultaneously transmitting/receiving signals of multiple bands by using a single signal transmitting/receiving device.

The present applicant has proposed the present invention to solve the aforementioned problems, and as a document of the related art, there is Korean Patent Application Laid-Open No. 10-2010-0065024 'Integrated Multiband Antenna'.

DISCLOSURE

Technical Problem

The present invention has been made in an effort to solve the aforementioned problems, and an object of the present invention is to provide a single antenna for satellite communication capable of receiving multi-band signals which may transmit/receive and process signals of multiple bands in the single antenna without replacing or reassembling multiple feed horns or reflectors.

Technical Solution

The present invention provides an antenna for satellite communication capable of receiving multi-band signals, the antenna including: a main reflector; a first feed horn which is provided on the main reflector and receives a signal of a first band; a first reflector which is disposed to be spaced apart from a reflective surface of the main reflector at a predetermined interval and transmits the signal of the first band to the first feed horn; a second feed horn which is provided on the main reflector and receives a signal of a second band; a second reflector which is disposed to be spaced apart from the reflective surface of the main reflector at a predetermined interval and transmits the signal of the second band to the second feed horn; and a third feed horn which is disposed to be spaced apart from the reflective surface of the main reflector at a predetermined interval and receives a signal of a third band.

In addition, the antenna may include a support unit which supports the first reflector, the second reflector and the third feed horn so that the first reflector, the second reflector and the third feed horn are rotatable relative to the main reflector, the first feed horn, or the second feed horn, in which the first reflector, the second reflector and the third feed horn are spaced apart from the reflective surface of the main reflector at a predetermined interval by the support unit.

In addition, the support unit may include: a support member which has one end connected to the main reflector and the other end extending toward a front side of the main reflector; a shaft which is connected to the other end of the support member; and a rotating module which is rotatably provided on the shaft and on which the first reflector, the second reflector and the third feed horn are mounted.

In addition, the rotating module may include: a rotating frame which is rotatably provided on the shaft and on which the first reflector, the second reflector and the third feed horn are mounted to be spaced apart from one another; a drive motor which is provided on the rotating frame; a driving pulley which is provided on a driving shaft of the drive motor; a driven pulley which is provided between the support member and the shaft; and a belt which connects the driving pulley and the driven pulley.

In addition, the rotating frame may include: an upper block which is rotatably provided on an upper portion of the shaft; a lower block which is rotatably provided on a lower portion of the shaft in a state in which the lower block is spaced apart from the upper block at a predetermined interval; a first support bar which supports the first reflector in a state in which both ends of the first support bar are connected to the upper block and the lower block; a second support bar which supports the second reflector in a state in which both ends of the second support bar are connected to the upper block and the lower block; and a fixing plate which supports the third feed horn in a state in which the fixing plate is connected to the upper block or the lower block.

In addition, the antenna may include: a first moving block which is mounted on the second support bar so as to be movable in a longitudinal direction of the second support bar; a fixing block which is connected to the first moving block and disposed to be inclined downward in a direction opposite to a direction in which the shaft is disposed; and a second moving block which is mounted on the fixing block so as to be movable in a longitudinal direction of the fixing block.

In addition, the drive motor and the driving pulley may relatively rotate to the driven pulley about the driven pulley.

In addition, a balance weight may be provided at a portion of the lower block disposed between the first support bar and the second support bar.

In addition, the rotating module may rotate any one of the first reflector, the second reflector and the third feed horn in a direction in which any one of the first reflector, the second reflector and the third feed horn faces the main reflector.

In addition, the rotating module may rotate such that the signal of the first band reflected by the first reflector enters the first feed horn.

In addition, the rotating module may rotate such that the signal of the second band reflected by the second reflector enters the second feed horn.

In addition, the rotating module may rotate such that the signal of the third band reflected by the main reflector enters the third feed horn.

In addition, based on a position where the signal of the first band reflected by the first reflector enters the first feed horn, a direction in which the rotating module rotates so that the signal of the second band reflected by the second reflector enters the second feed horn and a direction in which the rotating module rotates so that the signal of the third band reflected by the main reflector enters the third feed horn may be opposite to each other.

Advantageous Effects

The antenna for satellite communication capable of receiving multi-band signals according to the exemplary embodiment of the present invention may easily transmit/receive and process the signals of the multiple bands in the single antenna for satellite communication, and as a result, an installation space for the device is minimized, such that spatial utilization is improved.

In addition, according to the antenna for satellite communication capable of receiving multi-band signals according to the exemplary embodiment of the present invention, it is not necessary for an operator to replace or reinstall another feed horn in order to transmit/receive the signals of the multiple bands.

In addition, the antenna for satellite communication capable of receiving multi-band signals according to the exemplary embodiment of the present invention may be applied to a ship, an aircraft, a vehicle, or the like that travels locations with different signal bands, thereby easily processing a signal of a band suitable for a corresponding location.

MODE FOR INVENTION

Advantages and features of the present invention and methods of achieving the advantages and features will be clear with reference to exemplary embodiments described in detail below together with the accompanying drawings.

However, the present invention is not limited to the exemplary embodiments disclosed herein, but will be implemented in various forms, the exemplary embodiments are provided so as to completely disclose the present invention and to completely inform a person with ordinary skill in the art to which the present invention pertains with the scope of the present invention, and the present invention will be defined only by the scope of the appended claims.

Hereinafter, an antenna for satellite communication capable of receiving multi-band signals according to an exemplary embodiment of the present invention will be described in detail with reference to FIGS. 1 to 9. In the description of the present invention, the specific descriptions of publicly known related function or configurations will be omitted in order to prevent the specific descriptions from obscuring the subject matter of the present invention.

Figure 1:
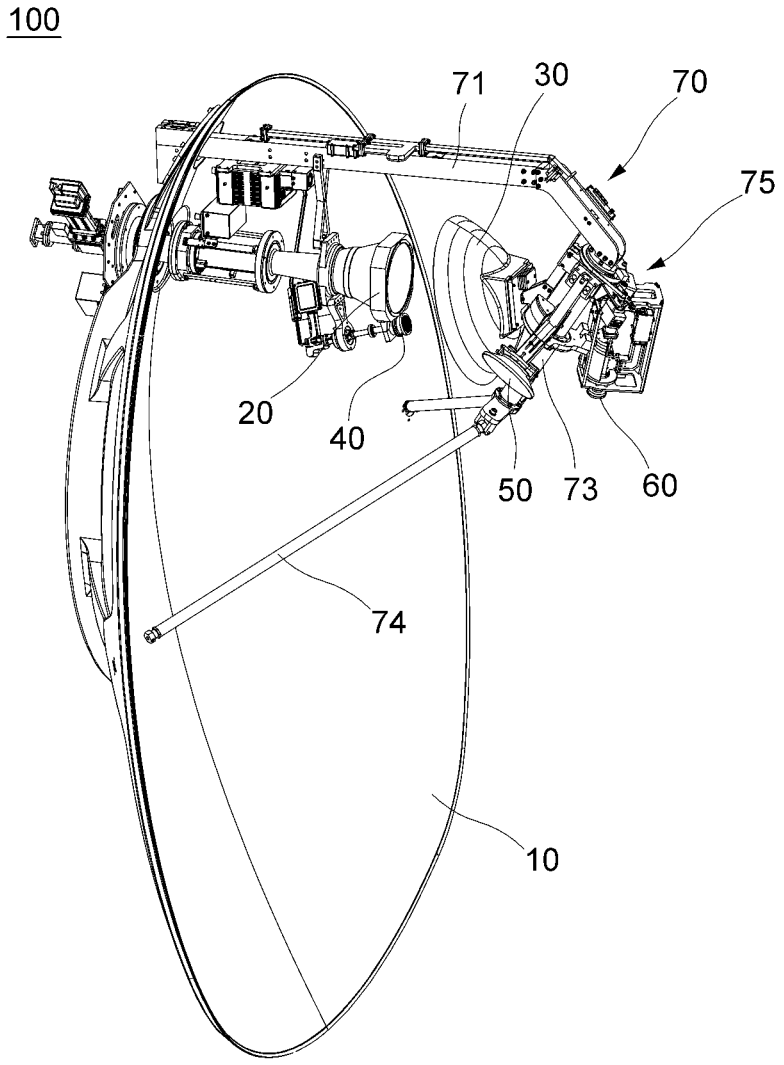
FIG. 1 is a perspective view of an antenna for satellite communication capable of receiving multi-band signals according to an exemplary embodiment of the present invention.
Figure 2:
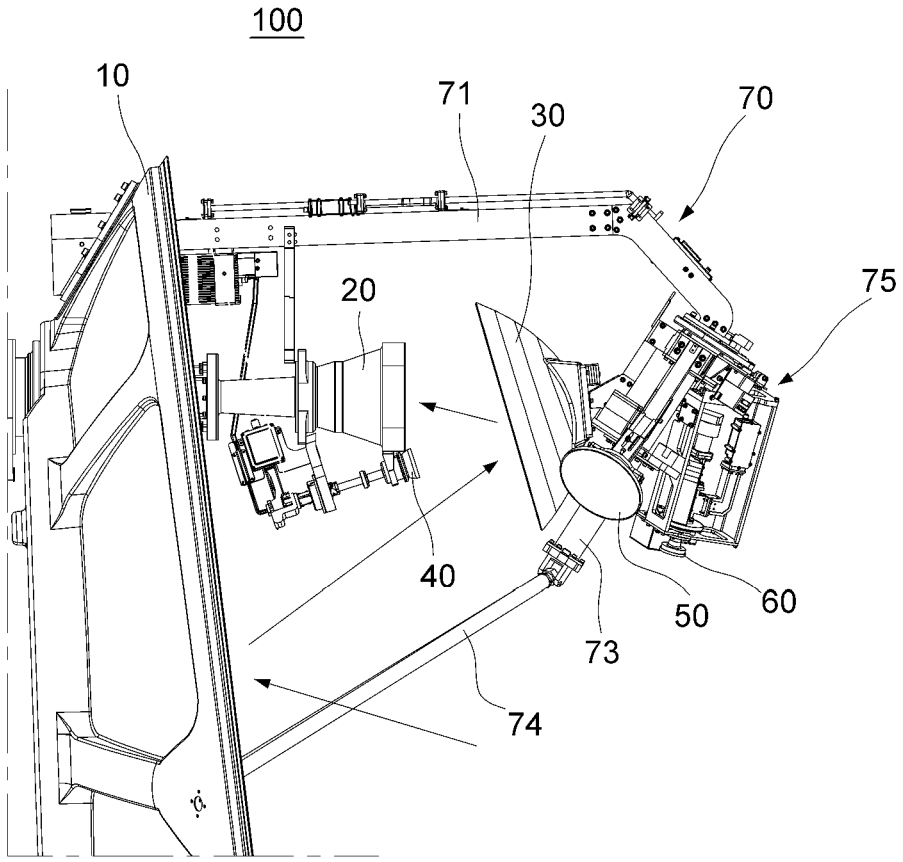
FIG. 2 is a side view of the antenna for satellite communication illustrated in FIG. 1.
Figure 3:
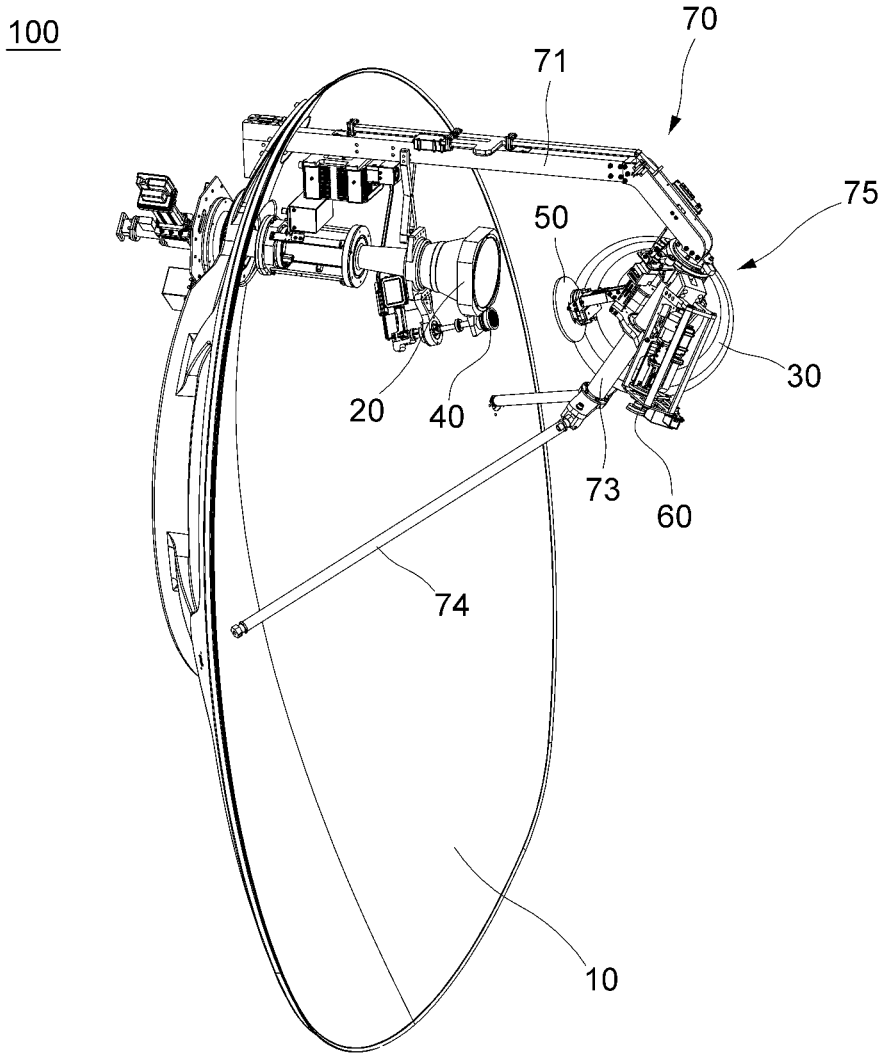
FIG. 3 is a perspective view illustrating a state in which a rotating module of the antenna for satellite communication illustrated in FIG. 1 is rotated and a second reflector is directed toward a main reflector.
Figure 4:
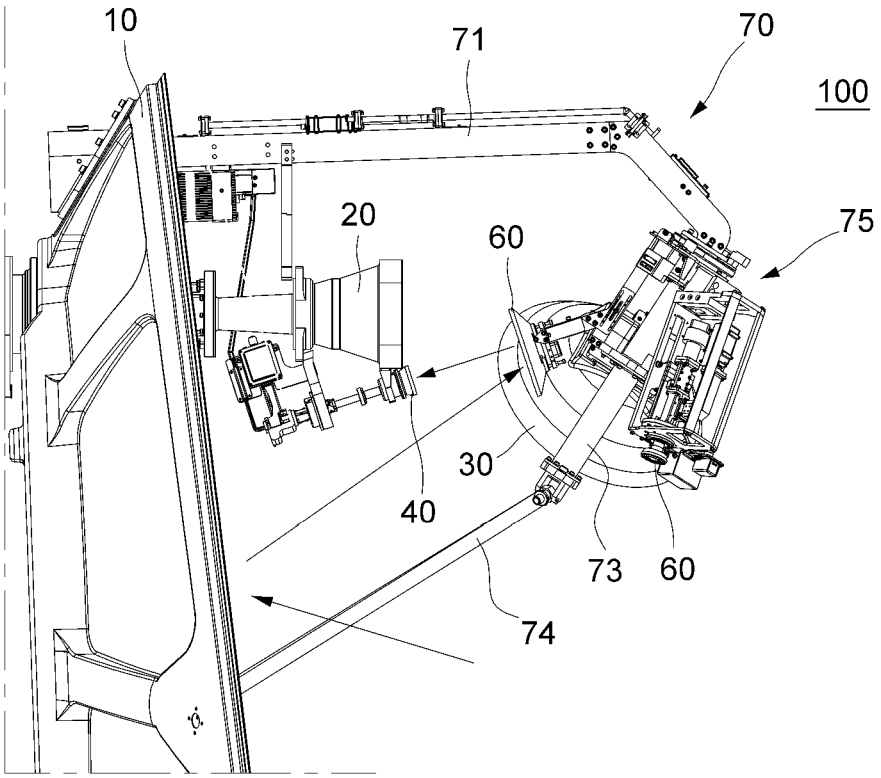
FIG. 4 is a side view of the antenna for satellite communication illustrated in FIG. 3.
Figure 5:
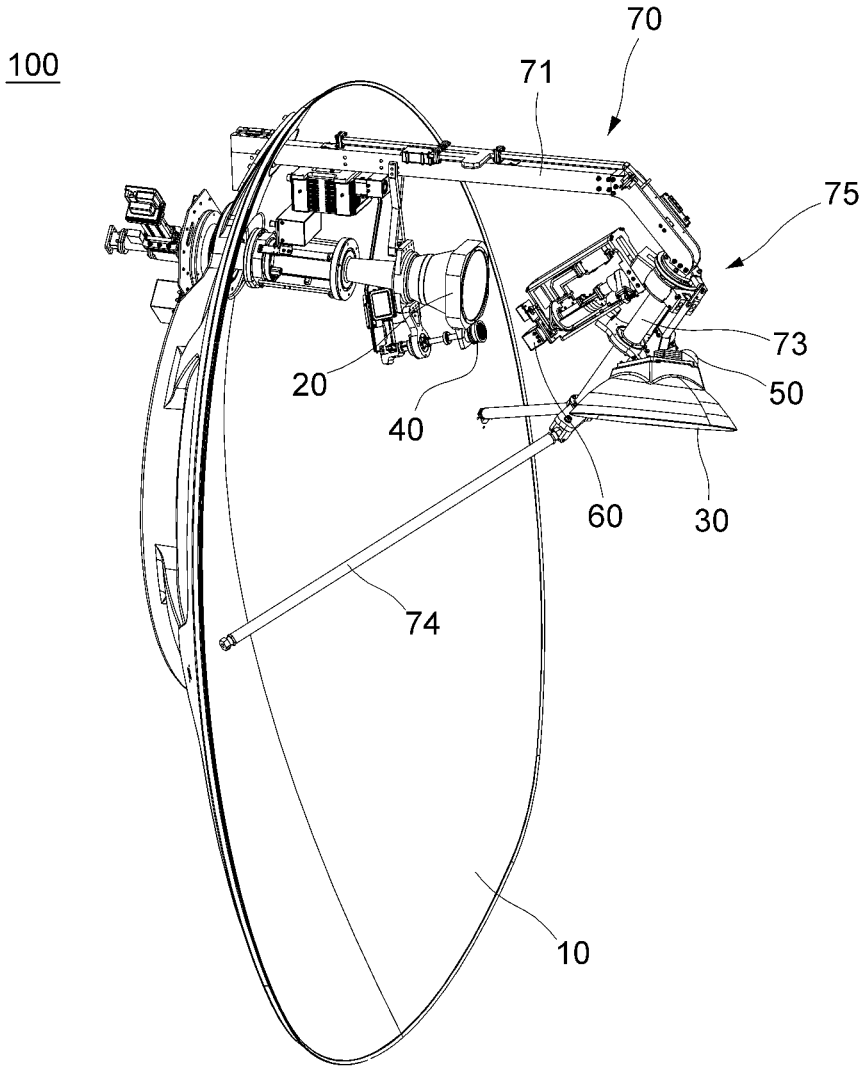
FIG. 5 is a perspective view illustrating a state in which the rotating module of the antenna for satellite communication illustrated in FIG. 3 is rotated and a third feed horn is directed toward the main reflector.
Figure 6:
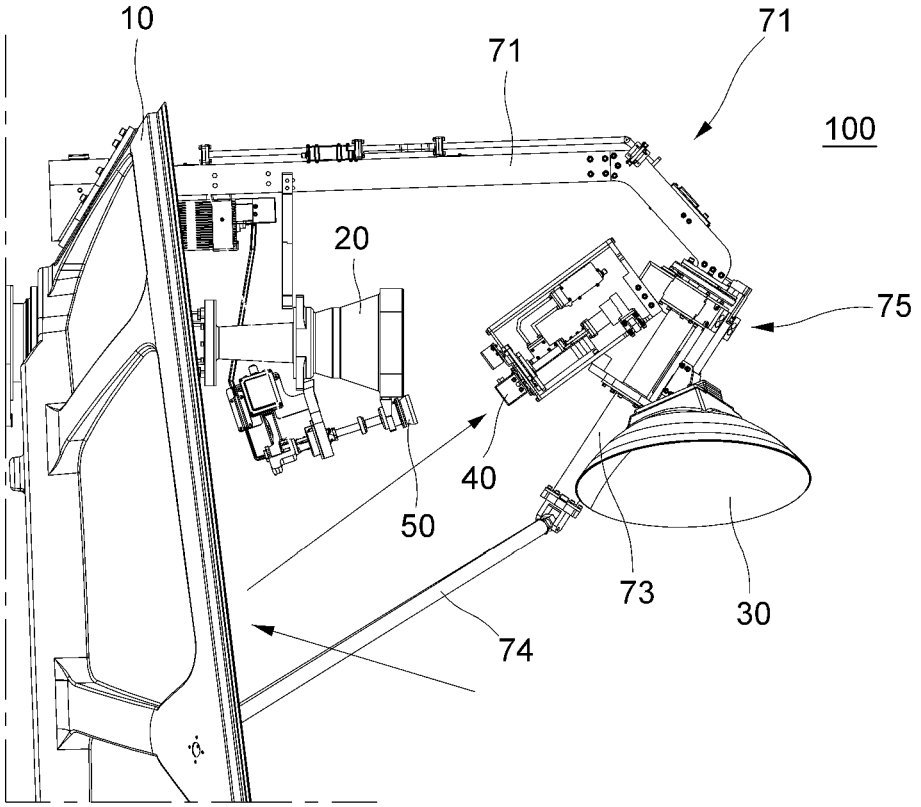
FIG. 6 is a side view of the antenna for satellite communication illustrated in FIG. 5.
Figure 7:
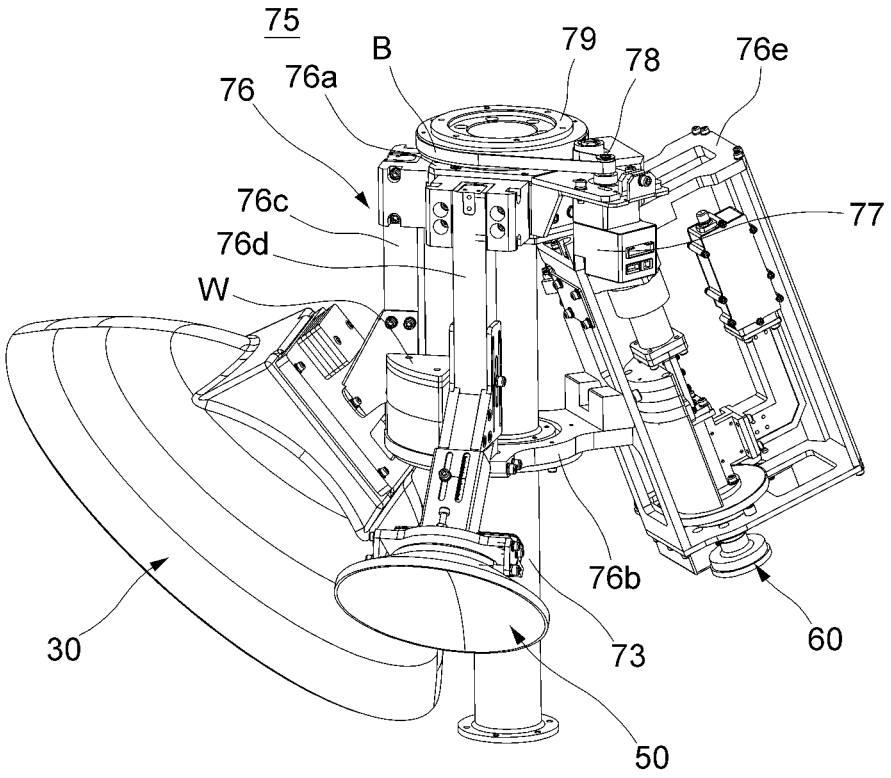
FIG. 7 is a perspective view illustrating a configuration of the rotating module of the antenna for satellite communication capable of receiving multi-band signals according to the exemplary embodiment of the present invention.
Figure 8:
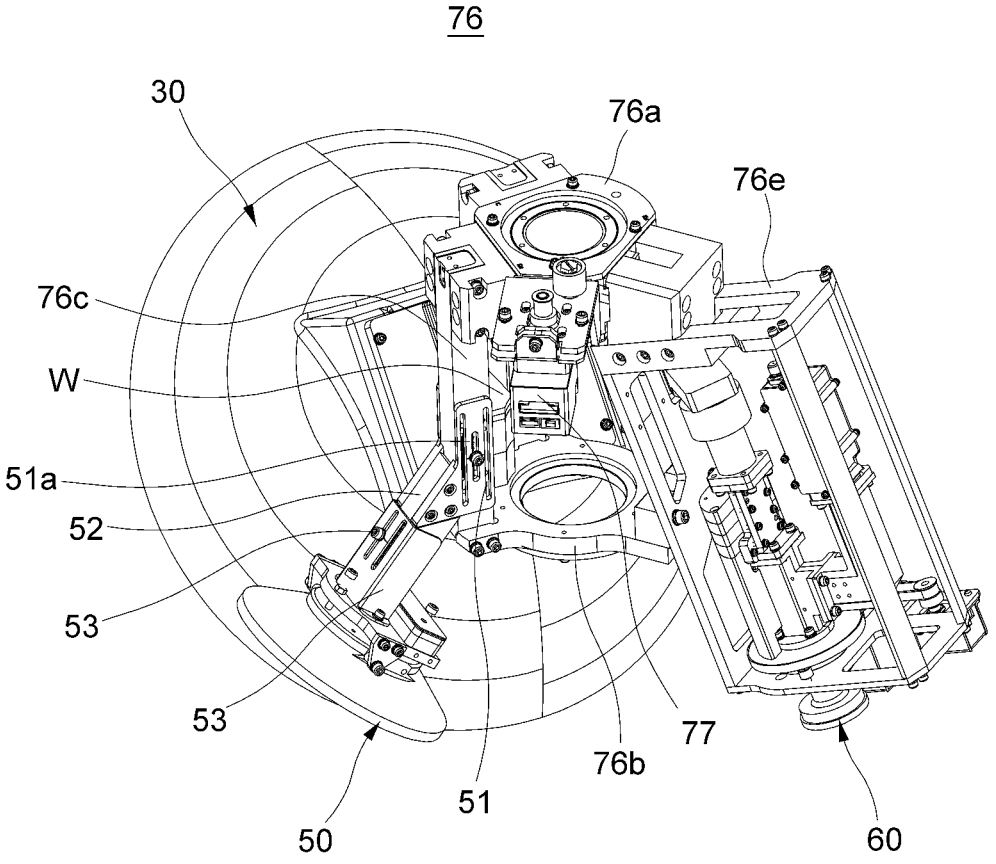
FIG. 8 is a perspective view illustrating a configuration of a rotating frame of the antenna for satellite communication capable of receiving multi-band signals according to the exemplary embodiment of the present invention.
Figure 9:
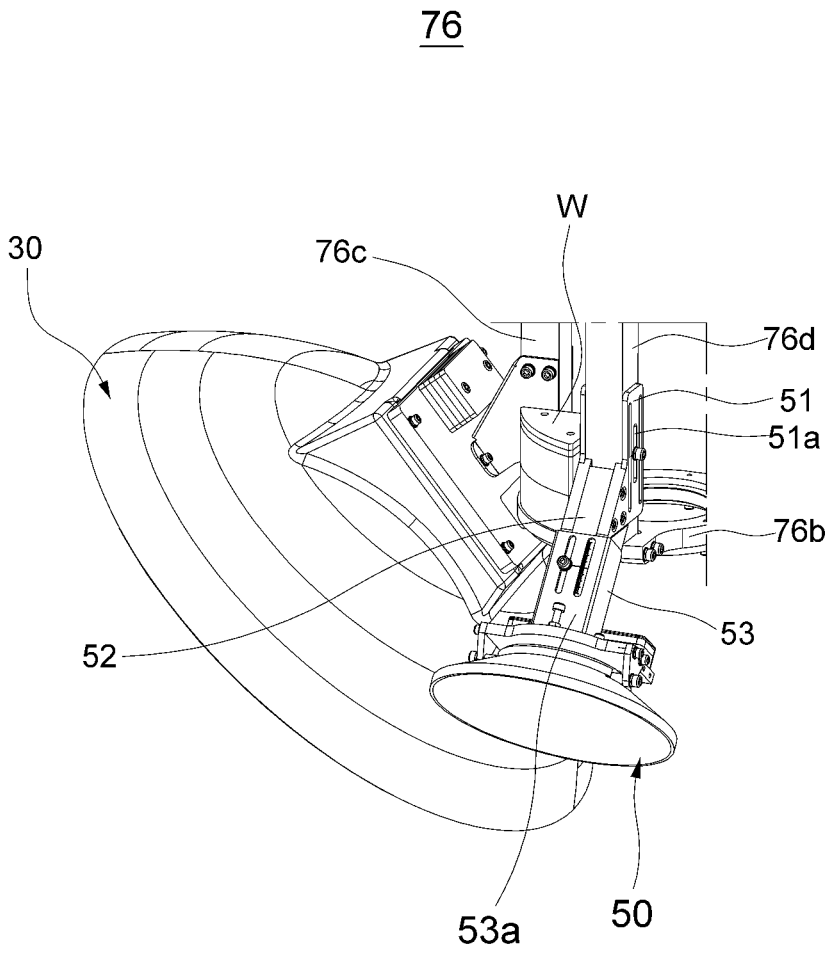
FIG. 9 is a perspective view of the second reflector illustrated in FIG. 8 when viewed at another angle.

FIG. 1 is a perspective view of an antenna for satellite communication capable of receiving multi-band signals according to an exemplary embodiment of the present invention, FIG. 2 is a side view of the antenna for satellite communication illustrated in FIG. 1, FIG. 3 is a perspective view illustrating a state in which a rotating module of the antenna for satellite communication illustrated in FIG. 1 is rotated and a second reflector is directed toward a main reflector, FIG. 4 is a side view of the antenna for satellite communication illustrated in FIG. 3, FIG. 5 is a perspective view illustrating a state in which the rotating module of the antenna for satellite communication illustrated in FIG. 3 is rotated and a third feed horn is directed toward the main reflector, FIG. 6 is a side view of the antenna for satellite communication illustrated in FIG. 5, FIG. 7 is a perspective view illustrating a configuration of the rotating module of the antenna for satellite communication capable of receiving multi-band signals according to the exemplary embodiment of the present invention, FIG. 8 is a perspective view illustrating a configuration of a rotating frame of the antenna for satellite communication capable of receiving multi-band signals according to the exemplary embodiment of the present invention, and FIG. 9 is a perspective view of the second reflector illustrated in FIG. 8 when viewed at another angle.

As illustrated in FIGS. 1 to 9, an antenna 100 for satellite communication capable of receiving multi-band signals according to an exemplary embodiment of the present invention may include a main reflector 10, a first feed horn 20 which is provided on the main reflector 10 and receives a signal of a first band (e.g., C band), a first reflector 30 which is disposed to be spaced apart from a reflective surface of the main reflector 10 at a predetermined interval and transmits the signal of the first band to the first feed horn 20, a second feed horn 40 which is provided on the main reflector 10 and receives a signal of a second band (e.g., Ka band), a second reflector 50 which is disposed to be spaced apart from a reflective surface of the main reflector 10 at a predetermined interval and transmits the signal of the second band to the second feed horn 40 and a third feed horn 60 which is disposed to be spaced apart from the reflective surface of the main reflector 10 at a predetermined interval and receives a signal of a third band (e.g., Ku band).

For reference, the first to third feed horns 20 to 60 according to the exemplary embodiment of the present invention may be feed horns for receiving or transmitting signals of any one frequency band among satellite signals of multiple frequency bands, for example, an L band, an S band, a C band, an X band, a Ku band, a K band, a Ka band, a Q band, a U band, a V band, an E band, a W band, an F band and a D band.

However, the types of the frequency bands for the satellite signals are just illustrative, and the frequency bands, which may be processed by the antenna for satellite communication according to the present invention, may include all of the signals of various frequency bands, in addition to the signal bands described above, which may be used to communicate with a satellite.

Hereinafter, for the convenience of description, the signal of the first band is referred to as a C band signal, the signal of the second band is referred to as a Ka band signal, and the signal of the third band is referred to as a Ku band signal.

The main reflector 10 may be rotated in a predetermined direction so as to be directed toward a position of a satellite, and the main reflector 10 may be installed on a movable body such as a ship or a vehicle.

The first feed horn 20 may transmit the signal of the first band to the satellite or receive the signal of the first band (C band) from the satellite, and the first feed horn 20 may be installed within a partial region of the main reflector 10. The first feed horn 20 may be provided to penetrate the main reflector 10 and disposed at a position fixed relative to the main reflector 10, and the first feed horn 20 may be provided such that the first feed horn 20 cannot be rotated or moved relative to the main reflector 10.

Meanwhile, in a case in which the antenna 100 for satellite communication is of an offset type, the first feed horn 20 may be installed at an edge portion of the main reflector 10 so that a shadow region caused by the first feed horn 20 is minimized. In a case in which the main reflector 10 of the antenna 100 for satellite communication is of a parabolic type, the first feed horn 20 may be installed within a central region of the main reflector 10.

As described above, the first feed horn 20 may be installed on the main reflector 10 so as to penetrate the main reflector 10. In this case, one end of the first feed horn 20 protrudes in a direction in which a reflective surface of the main reflector 10 is disposed, and the other end of the first feed horn 20 may be disposed in a direction opposite to the direction in which the reflective surface of the main reflector 10 is disposed.

As described above, the first reflector 30, the second reflector 50 and the third feed horn 60 may be disposed to be spaced apart from the reflective surface of the main reflector 10 at predetermined intervals. That is, the first reflector 30, the second reflector 50 and the third feed horn 60 may be provided to be spaced apart from the main reflector 10 so as to face the main reflector 10. In more detail, the first reflector 30, the second reflector 50 and the third feed horn 60 may be positioned at a position where a center of a radius of curvature of the reflective surface of the main reflector 10 is present, and the first reflector 30, the second reflector 50 and the third feed horn 60 may be provided to be spaced apart from the main reflector 10 at a distance.

Meanwhile, the antenna 100 for satellite communication according to the exemplary embodiment of the present invention may include a support unit 70 which supports the first reflector 30, the second reflector 50 and the third feed horn 60 in the state in which the first reflector 30, the second reflector 50, and the third feed horn 60 are spaced apart from the reflective surface of the main reflector 10 at the predetermined intervals.

In this case, the first reflector 30, the second reflector 50 and the third feed horn 60 are rotatably provided on the support unit 70, such that the first reflector 30, the second reflector 50 and the third feed horn 60 may be disposed to be directed toward the reflective surface of the main reflector 10 on which the first feed horn 20 and the second feed horn 40 are provided. That is, the first reflector 30, the second reflector 50 and the third feed horn 60 may be provided to be rotatable about the support unit 70.

The support unit 70 may include a support member 71 which has one end connected to the main reflector 10 and the other end extending toward a front side of the main reflector 10, a shaft 73 which is provided at the other end of the support member 71, and a rotating module 75 which is rotatably provided on the shaft 73 and on which the first reflector 30, the second reflector 50 and the third feed horn 60 are mounted. Here, the support unit 70 may further include an auxiliary support member 74 which has one end connected to the shaft 73 to support the shaft 73 and the other end fixed to the main reflector 10.

The first reflector 30, the second reflector 50, the third feed horn 60, the shaft 73, and the rotating module 75 may be supported by the support member 71 and the auxiliary support member 74. Here, the number of support members 71 is 1, and the number of auxiliary support members 74 is 2, such that the support member 71 and the auxiliary support member 74 may serve as a tripod and support the first reflector 30, the second reflector 50, the third feed horn 60, the shaft 73, and the rotating module 75.

One end of the support member 71 and one end of each of the auxiliary support members 74 may be fixed to the edge portion of the main reflector 10, and as described above, the other end of the support member 71 and the other end of each of the auxiliary support members 74 extend by predetermined distances toward the front side of the reflective surface of the main reflector 10. Therefore, the first reflector 30, the second reflector 50 and the third feed horn 60, which are provided on the shaft 73 through the rotating module 75, may be spaced apart, at predetermined distances, from the first feed horn 20 and the second feed horn 40 provided on the main reflector 10.

The shaft 73 is fixedly connected to the other end of the support member 71, and the shaft 73 may be disposed to be inclined toward the central portion of the reflective surface of the main reflector 10. That is, one end of the shaft 73 is fixedly connected to the other end of the support member 71 and the other end of the shaft 73 extends to be inclined toward the central portion of the reflective surface of the main reflector 10, such that the shaft 73 may be fixedly connected to the auxiliary support members 74.

Further, as illustrated in FIG. 7, the rotating module 75 may be rotatably mounted on the shaft 73 while supporting the first reflector 30, the second reflector 50 and the third feed horn 60.

As illustrated in FIG. 2, the rotating module 75 is mounted on the shaft 73 so as to be rotatable about a central axis of the shaft 73 and may allow the first reflector 30 to be disposed to face the first feed horn 20. In this case, when the first reflector 30 on the shaft 73 is positioned to face the first feed horn 20 and the second feed horn 40 provided on the main reflector 10, the second reflector 50 and the third feed horn 60 may be disposed on the shaft 73 in a direction in which the second reflector 50 and the third feed horn 60 do not face the first feed horn 20 and second feed horn 40.

When the first reflector 30 is disposed to be directed toward the first feed horn 20 by the rotating module 75, the signal of the first band emitted from the satellite is reflected primarily by the concave reflective surface of the main reflector 10, and the signal of the first band, which is reflected by the main reflector 10, is transmitted to the first reflector 30 and reflected secondarily by the first reflector 30, such that the signal of the first band may be transmitted to the first feed horn 20.

That is, when the antenna 100 for satellite communication according to the exemplary embodiment of the present invention receives the signal of the first band from the satellite, the rotating module 75 is rotated relative to the shaft 73 so that the first feed horn 20 and the first reflector 30 face each other, as illustrated in FIGS. 1 and 2. The signal of the first band is transmitted to the first feed horn 20 by being reflected twice by the main reflector 10 and the first reflector 30.

FIGS. 3 and 4 illustrate a case in which the antenna 100 for satellite communication according to the exemplary embodiment of the present invention receives the signal of the second band (Ka band). As illustrated in FIGS. 3 and 4, the rotating module 75 is rotated about the central axis of the shaft 73, such that the second reflector 50 may be disposed to face the second feed horn 40. In this case, the first reflector 30 and the third feed horn 60 are disposed in a direction in which the first reflector 30 and the third feed horn 60 do not face the reflective surface of the main reflector 10. That is, in the state in which the second reflector 50 faces the second feed horn 40, the first reflector 30 and the third feed horn 60 do not face the first feed horn 20 or the second feed horn 40.

When the second reflector 50 is rotated on the shaft 73 by the rotating module 75 so that the second reflector 50 is directed toward the second feed horn 40, the second reflector 50 may receive the signal of the second band reflected by the reflective surface of the main reflector 10 and may transmit the signal of the second band to the second feed horn 40. The signal of the second band emitted from the satellite is reflected primarily by the concave reflective surface of the main reflector 10, and the signal of the second band, which is reflected by the main reflector 10, is transmitted to the second reflector 50 and reflected secondarily by the second reflector 50, such that the signal of the second band may be transmitted to the second feed horn 40.

As described above, when the antenna 100 for satellite communication according to the exemplary embodiment of the present invention receives the signal of the second band from the satellite, the rotating module 75 is rotated relative to the shaft 73 so that the second feed horn 40 and the second reflector 50 face each other, as illustrated in FIGS. 3 and 4. The signal of the second band is transmitted to the second feed horn 40 by being reflected twice by the main reflector 10 and the second reflector 50.

For reference, the second feed horn 40 may transmit the signal of the second band to the satellite or may receive the signal of the second band from the satellite, and in the exemplary embodiment of the present invention, the second feed horn 40 is illustrated in the drawings as being provided on the main reflector 10 and connected to the first feed horn 20. The second feed horn 40 is fixedly installed on the first feed horn 20, while the first feed horn 20 is fixed to the main reflector 10. An opening of the first feed horn 20, which receives the signal, is relatively large, while an opening of the second feed horn 40, which receives the signal, is relatively small. In addition, the second feed horn 40 may be provided to be inclined toward the first feed horn 20 so that the opening of the first feed horn 20 and the opening of the second feed horn 40 are adjacent to each other.

FIGS. 5 and 6 illustrate a case in which the antenna 100 for satellite communication according to the exemplary embodiment of the present invention receives the signal of the third band (Ku band). As illustrated in FIGS. 5 and 6, the rotating module 75 is rotated about the central axis of the shaft 73, such that the third feed horn 60 may be disposed to face the reflective surface of the main reflector 10. That is, the third feed horn 60 is rotated about the shaft 73 by the rotation of the rotating module 75, such that the third feed horn 60 faces the concave reflective surface of the main reflector 10. In this case, the first reflector 30 and the second reflector 50 are disposed in the direction in which the first reflector 30 and the second reflector 50 do not face the reflective surface of the main reflector 10.

When the third feed horn 60 is disposed to be directed toward the concave reflective surface of the main reflector 10 by the rotating module 75, the third feed horn 60 may receive the signal of the third band reflected by the reflective surface of the main reflector 10. That is, the signal of the third band emitted from the satellite is reflected primarily by the main reflector 10 and then transmitted to the third feed horn 60. In this process, the signal of the third band is not reflected by the first reflector 30 or the second reflector 50. As described above, unlike the signals of the first and second bands, the signal of the third band is reflected only by the main reflector 10 and then enters the third feed horn 60.

The third feed horn 60 may transmit the signal of the third band to the satellite or may receive the signal of the third band from the satellite, and the third feed horn 60 may be installed on the rotating module 75 such that the third feed horn 60 is electrically separated from the first reflector 30 and the second reflector 50.

In the antenna 100 for satellite communication according to the exemplary embodiment of the present invention, when the rotating module 75 rotates counterclockwise by 85 degrees from the state in which the antenna 100 receives the signal of the first band, that is, from the position where the first reflector 30 faces the first feed horn 20, the antenna 100 comes into the state in which the antenna 100 receives the signal of the second band, that is, the state in which the second reflector 50 faces the second feed horn 40. In addition, when the rotating module 75 rotates clockwise by 145 degrees from the state in which the antenna 100 receives the signal of the first band, that is, from the position where the first reflector 30 faces the first feed horn 20, the antenna 100 comes into the state in which the antenna 100 receives the signal of the third band, that is, the state in which the third feed horn 60 faces the concave reflective surface of the main reflector 10.

Referring to FIGS. 7 and 8, the first reflector 30, the second reflector 50 and the third feed horn 60 may be disposed in the form of a triangle based on the shaft 73. That is, a triangular is made by connecting points of the first reflector 30, the second reflector 50 and the third feed horn 60 when the points are most distant from the shaft 73. In this case, the triangular may be formed in the form of an asymmetric triangular. As described above, the first reflector 30, the second reflector 50 and the third feed horn 60 are rotated on the shaft 73 by the rotating module 75, thereby transmitting/receiving signals of various bands to/from the satellite.

That is, the two reflectors (the first reflector 30 and the second reflector 50) and the single feed horn (the third feed horn 60), which are disposed based on the shaft 73, are positioned to be rotated while making curved paths relative to the reflective surface of the main reflector 10, and as a result, it is possible to reduce a movement distance of the reflector or the feed horn and to configure the rotating module so that more reflectors or more feed horns are included.

Meanwhile, the configuration in which the first reflector 30, the second reflector 50 and the third feed horn 60 are supported and rotated on the shaft 73 may be implemented by various types of publicly known driving devices.

For example, as illustrated in FIG. 7, the rotating module 75 may include a rotating frame 76 which is rotatably provided on the shaft 73 and on which the first reflector 30, the second reflector 50 and the third feed horn 60 are mounted to be spaced apart from one another, a drive motor 77 which is provided on the rotating frame 76, a driving pulley 78 which is provided on a driving shaft of the drive motor 77, a driven pulley 79 which is provided between the support member 71 and the shaft 73, and a belt B which connects the driving pulley 78 and the driven pulley 79.

As illustrated in FIGS. 7 and 8, the rotating frame 76 may include an upper block 76*a* which is rotatably provided on an upper portion of the shaft 73, a lower block 76*b* which is spaced apart from the upper block 76*a* at a predetermined interval and rotatably provided on a lower portion of the shaft 73, a first support bar 76*c* which supports the first reflector 30 in a state in which both ends of the first support bar 76*c* are connected to the upper block 76*a* and the lower block 76*b*, a second support bar 76*d* which supports the second reflector 50 in a state in which both ends of the second support bar 76*d* are connected to the upper block 76*a* and the lower block 76*b*, and a fixing plate 76*e* which supports the third feed horn 60 in a state in which the fixing plate 76*e* is connected to the upper block 76*a* or the lower block 76*b*.

A non-illustrated bearing is provided between the rotating frame 76 and the shaft 73, and the bearing may be provided between the upper block 76*a* and the shaft 73 and may also be provided between the lower block 76*b* and the shaft 73.

The drive motor 77 provides driving power so that the upper block 76*a* and the lower block 76*b* of the rotating frame 76 may rotate in a circumferential direction of the shaft 73, and the drive motor 77 may be fixedly provided on the upper block 76*a* of the rotating frame 76.

Further, the driving shaft of the drive motor 77 may be disposed to protrude upward toward the other end of the shaft 73 so that the driving pulley 78 may be disposed at the same height as the driven pulley 79 disposed between the support member 71 and the shaft 73.

The driven pulley 79 is disposed between the other end of the support member 71 and one end of the shaft 73, and the driven pulley 79 may be fixedly connected to the other end of the support member 71 or one end of the shaft 73. That is, the driven pulley 79 may be fixedly connected to an upper end of the shaft 73 so that the driven pulley 79 cannot rotate relative to the shaft 73. As described above, the drive motor 77 and the driving pulley 78 may relatively rotate to the driven pulley 79. That is, when the drive motor 77 operates, the drive motor 77 and the driving pulley 78 may rotate about the driven pulley 79 relative to the driven pulley 79.

Therefore, when the drive motor 77 is operated by a user's control command, the driving pulley 78 is rotated to transmit rotational driving power to the belt B and may be moved in an inner circumferential direction of the belt B. Then, the upper block 76*a* connected to the drive motor 77 is rotated about the shaft 73, and the first support bar 76*c*, the second support bar 76*d*, and the fixing plate 76*e*, which are connected to the upper block 76*a*, are also rotated about the shaft 73, such that any one of the first reflector 30, the second reflector 50 and the third feed horn 60 may be positioned to be directed toward the reflective surface of the main reflector 10 in order to receive the signal of any one of the first to third bands.

The configuration for rotating the first reflector 30, the second reflector 50 and the third feed horn 60 on the shaft 73 may be implemented by various types of publicly known rotating devices and may be implemented in various forms in accordance with a design condition by those skilled in the art in the corresponding field.

Meanwhile, the second reflector 50 may be configured to be movable in a longitudinal direction of the second support bar 76*d*. In addition, the second reflector 50 may be configured to be movable on the second support bar 76*d* so that an interval between the second reflector 50 and the reflective surface of the main reflector 10 is adjusted in the state in which the second reflector 50 is disposed to be directed toward the reflective surface of the main reflector 10.

That is, as illustrated in FIGS. 8 and 9, the second reflector 50 may include a first moving block 51 which is mounted on the second support bar 76*d* so as to be movable in the longitudinal direction of the second support bar 76*d*, a fixing block 52 which is connected to the first moving block 51 and disposed to be inclined downward in a direction opposite to the direction in which the shaft 73 is disposed, and a second moving block 53 which is mounted on the fixing block 52 so as to be movable a longitudinal direction of the fixing block 52. The second reflector 50 may be connected to the second moving block 53.

The first moving block 51 may be mounted at both sides of a lower end portion of the second support bar 76*d*. Further, the first moving block 51 may have a first enlongated hole 51*a* into which a threaded portion of a fastening means such as a bolt may be inserted. Further, the second support bar 76*d* also has a coupling hole (not illustrated) into which the threaded portion of the fastening means may be inserted.

For reference, the first enlongated hole 51*a* may have, for example, a size that allows a threaded portion of a bolt to pass therethrough but does not allow a head of the bolt to pass therethrough. Therefore, the first moving block 51 may be fastened to the second support bar 76*d* by being pressed by the head of the bolt of which the threaded portion is inserted into the first enlongated hole 51*a*.

The first moving block 51, which has the aforementioned configuration, may be fastened to the second support bar 76*d* by the first enlongated hole 51*a* and the fastening means, and the position of the first moving block 51 may be changed in the longitudinal direction of the second support bar 76*d*.

Meanwhile, a graduation for indicating the position of the first moving block 51 may be provided on the second support bar 76*d*. The graduation may be exposed through the first enlongated hole 51*a* or another enlongated hole formed in the first moving block 51 so that an operator may check the graduation with the naked eye. Therefore, with the graduation, the operator may precisely adjust the position of the first moving block 51 on the second support bar 76*d*.

Since the fixing block 52 is connected to the first moving block 51 by the fastening means, and as described above, the fixing block 52 may be disposed to be inclined downward in the direction opposite to the direction in which the shaft 73 is disposed.

One end of the second moving block 53 may be connected to the fixing block 52, and the other end of the second moving block 53 may be connected to the second reflector 50. A second enlongated hole 53*a*, into which a threaded portion of a fastening means such as a bolt may be inserted, may be formed at one end portion of the second moving block 53. Further, the fixing block 52 may also have a coupling hole (not illustrated) into which the threaded portion of the fastening means may be inserted.

For reference, the second enlongated hole 53*a* may have, for example, a size that allows a threaded portion of a bolt to pass therethrough but does not allow a head of the bolt to pass therethrough. Therefore, the second moving block 53 may be fastened to the fixing block 52 by being pressed by the head of the bolt of which the threaded portion is inserted into the second enlongated hole 53*a*.

The second moving block 53, which has the aforementioned configuration, may be fastened to the fixing block 52 by the second enlongated hole 53*a* and the fastening means, and the position of the second moving block 53 may be changed in the longitudinal direction of the fixing block 52, such that a distance between the second reflector 50 and the reflective surface of the main reflector 10 may also be adjusted.

Meanwhile, a graduation for indicating the position of the second moving block 53 may also be provided on the fixing block 52. The graduation provided on the second moving block 53 may be exposed through the second enlongated hole 53*a* or another enlongated hole formed in the second moving block 53 so that the operator may check the graduation with the naked eye. Therefore, with the graduation formed on the fixing block 52, the operator may precisely adjust the position of the second moving block 53 on the fixing block 52.

By the first moving block 51 and the second moving block 53, the height of the second reflector 50 on the second support bar 76*d* may be adjusted, or the distance between the second reflector 50 and the reflective surface of the main reflector 10 may be adjusted, and as a result, it is possible to easily change the position of the second reflector 50 corresponding to the position of the second feed horn 40 provided on the main reflector 10. That is, a focal point of the second reflector 50 and a focal point of the second feed horn 40 may be accurately adjusted.

Further, as illustrated in FIGS. 7 and 9, a balance weight W may be provided at a portion of the lower block 76*b* disposed between the first support bar 76*c* for supporting the first reflector 30 and the second support bar 76*d* for supporting the second reflector 50.

The balance weight W may prevent a focal point of the first feed horn 20 or the second feed horn 40 from swaying as the first reflector 30 or the second reflector 50 is moved by a weight of the third feed horn 60 when the first reflector 30 or the second reflector 50 faces the reflective surface of the main reflector 10.

Because the third feed horn 60 includes electrical devices for band transmission and reception, lenses, and various types of other electrical devices, the third feed horn 60 may be relatively heavier in weight than the first reflector 30 or the second reflector 50. Therefore, when the first reflector 30 or the second reflector 50 is disposed to be directed toward the first feed horn 20 or the second feed horn 40 provided on the main reflector 10, the first reflector 30 or the second reflector 50 may be tilted, in the direction in which the third feed horn 60 is disposed, because of the weight of the third feed horn 60 disposed in the direction in which the third feed horn 60 does not face the reflective surface of the main reflector 10. Therefore, the balance weight W may be provided on the lower block 76*b* to prevent a center of gravity of the first reflector 30 or the second reflector 50 from being tilted in the direction in which the third feed horn 60 is disposed when the first reflector 30 or the second reflector 50 is disposed to be directed toward the reflective surface of the main reflector 10. In addition, since the balance weight W is provided, loads of the first reflector 30, the second reflector 50 and the third feed horn 60 may be balanced when the rotating module 75 rotates about the shaft 73, abrasion or damage caused by eccentricity of the shaft 73 may be prevented, and the smooth rotation of the rotating module 75 may be ensured.

The antenna 100 for satellite communication according to the exemplary embodiment of the present invention, which has the aforementioned configuration, may easily transmit/receive and process the signals of the multiple bands in the single antenna, and as a result, an installation space for the device is minimized such that spatial utilization is improved, and it is not necessary for the operator to perform a process of replacing or reinstalling another feed horn in order to transmit/receive the signals of the multiple bands.

In addition, the antenna 100 for satellite communication according to the exemplary embodiment of the present invention may be applied to a ship, an aircraft, or a vehicle that travels locations with different signal bands, thereby easily processing a signal of a band suitable for a corresponding location.

While the specific exemplary embodiments according to the present invention have been described above, the exemplary embodiments may be modified to various exemplary embodiments without departing from the scope of the present invention.

Therefore, the scope of the present invention should not be limited to the described exemplary embodiments, and should be defined by not only the claims to be described below, but also that equivalent to the claims.

INDUSTRIAL APPLICABILITY

The present invention may be used for an antenna for satellite communication capable of receiving multi-band signals which may receive signals through multiple satellite communications.

The invention claimed is:

1. An antenna for satellite communication capable of receiving multi-band signals, the antenna comprising:

a main reflector;

a first feed horn which is provided on the main reflector and receives a signal of a first band;

a first reflector which is disposed to be spaced apart from a reflective surface of the main reflector at a predetermined interval and transmits the signal of the first band to the first feed horn;

a second feed horn which is provided on the main reflector and receives a signal of a second band;

a second reflector which is disposed to be spaced apart from the reflective surface of the main reflector at the predetermined interval and transmits the signal of the second band to the second feed horn;

a third feed horn which is disposed to be spaced apart from the reflective surface of the main reflector at the predetermined interval and receives a signal of a third band; and a support which supports the first reflector, the second reflector and the third feed horn so that the first reflector, the second reflector and the third feed horn are rotatable relative to the main reflector, the first feed horn or the second feed horn, wherein the first reflector, the second reflector and the third feed horn are spaced apart from the reflective surface of the main reflector at the predetermined interval by the support.

2. The antenna according to claim 1, wherein the support includes:

a support member which has one end connected to the main reflector and the other end extending toward a front side of the main reflector;

a shaft which is connected to the other end of the support member; and a rotating module which is rotatably provided on the shaft and on which the first reflector, the second reflector and the third feed horn are mounted.

3. The antenna according to claim 2, wherein the rotating module includes:

a rotating frame which is rotatably provided on the shaft and on which the first reflector, the second reflector and the third feed horn are mounted to be spaced apart from one another;

a drive motor which is provided on the rotating frame;

a driving pulley which is provided on a driving shaft of the drive motor;

a driven pulley which is provided between the support member and the shaft; and a belt which connects the driving pulley and the driven pulley.

4. The antenna according to claim 3, wherein the rotating frame includes:

an upper block which is rotatably provided on an upper portion of the shaft;

a lower block which is rotatably provided on a lower portion of the shaft in a state in which the lower block is spaced apart from the upper block at a predetermined interval;

a first support bar which supports the first reflector in a state in which both ends of the first support bar are connected to the upper block and the lower block;

a second support bar which supports the second reflector in a state in which both ends of the second support bar are connected to the upper block and the lower block; and a fixing plate which supports the third feed horn in a state in which the fixing plate is connected to the upper block or the lower block.

5. The antenna according to claim 4, comprising:

a first moving block which is mounted on the second support bar so as to be movable in a longitudinal direction of the second support bar;

a fixing block which is connected to the first moving block and disposed to be inclined downward in a direction opposite to a direction in which the shaft is disposed; and a second moving block which is mounted on the fixing block so as to be movable in a longitudinal direction of the fixing block.

6. The antenna according to claim 3, wherein the drive motor and the driving pulley relatively rotate to the driven pulley about the driven pulley.

7. The antenna according to claim 4, wherein a balance weight is provided at a portion of the lower block disposed between the first support bar and the second support bar.

8. The antenna according to claim 2, wherein the rotating module rotates any one of the first reflector, the second reflector and the third feed horn in a direction in which any one of the first reflector, the second reflector and the third feed horn faces the main reflector.

9. The antenna according to claim 2, wherein the rotating module rotates such that the signal of the first band reflected by the first reflector enters the first feed horn.

10. The antenna according to claim 9, wherein the rotating module rotates such that the signal of the second band reflected by the second reflector enters the second feed horn.

11. The antenna according to claim 10, wherein the rotating module rotates such that the signal of the third band reflected by the main reflector enters the third feed horn.

12. The antenna according to claim 11, wherein based on a position where the signal of the first band reflected by the first reflector enters the first feed horn, a direction in which the rotating module rotates so that the signal of the second band reflected by the second reflector enters the second feed horn and a direction in which the rotating module rotates so that the signal of the third band reflected by the main reflector enters the third feed horn are opposite to each other.

* * * * *